US005437578A

United States Patent [19]

Wasserberger et al.

[11] Patent Number: 5,437,578

[45] Date of Patent: Aug. 1, 1995

[54] SET OF BOWLING BALLS HAVING SIMILAR PROPERTIES AND CORES THEREFOR

[75] Inventors: William Wasserberger, Muskegon, Mich.; Raymond M. Edwards, Matteson, Ill.

[73] Assignee: Brunswick Bowling & Billiards, Muskegon, Mich.

[21] Appl. No.: 147,689

[22] Filed: Nov. 4, 1993

[51] Int. Cl.[6] ..... A63B 37/10

[52] U.S. Cl. ..... 473/126; 273/DIG. 20

[58] Field of Search ..... 473/125, 126; 273/DIG. 20, 59 B, 220, 230, 65 EC

[56] References Cited

U.S. PATENT DOCUMENTS

| | | | |
|---|---|---|---|
| 4,131,277 | 12/1978 | Randolph | 473/125 |
| 4,183,527 | 1/1980 | Amburgey | 273/DIG. 20 |
| 4,264,071 | 4/1981 | Randolph | 473/125 |
| 4,802,671 | 2/1989 | Gentiluomo | 473/125 |
| 5,098,096 | 3/1992 | Gentil | 473/125 |
| 5,125,656 | 6/1992 | Fabanich | 473/126 |

*Primary Examiner*—Vincent Millin
*Assistant Examiner*—William M. Pierce
*Attorney, Agent, or Firm*—Wood, Phillips, VanSanten, Clark & Mortimer

[57] ABSTRACT

The lack of uniformity in reaction characteristics of bowling balls of differing weights is avoided by a family of bowling balls having nearly identical reaction characteristics which include a plurality of the balls, each of the same nominal diameter and each differing in weight from the others by about one pound or more. Each ball includes a cover (10) and a core (14, 16, 18, 20) of a material different from the cover (10). Each core (14, 16, 18, 20) is constructed and arranged within its cover to produce a first radius of gyration about a first axis and a second, different radius of gyration about a second axis that is generally transverse to the first axis. The first radius of gyration of all of the balls is substantially identical and the second radius of gyration of all of the balls is substantially identical.

11 Claims, 2 Drawing Sheets

SET OF BOWLING BALLS HAVING SIMILAR PROPERTIES AND CORES THEREFOR

FIELD OF THE INVENTION

This invention relates to bowling balls, and more particularly, to bowling balls having novel cores and to a family of bowling balls having generally identical reactive characteristics irrespective of their weight.

BACKGROUND OF THE INVENTION

Bowlers, like any other athlete, are always looking for a competitive advantage. One area in which this advantage is constantly sought is in the equipment used by the bowler. And of the equipment used by any specific bowler, the most important is the bowling ball.

For the better part of a century, bowling balls have been manufactured of two or more parts. An inner part is termed the "core" while the outer part is termed the "cover". Not infrequently, the core itself is made up of more than one part.

Core density and/or core geometry exert significant effects over the reactive characteristics of any given ball. The term "reactive characteristics" is commonly employed to denote the degree to which a ball will hook, i.e. deviate from the line of travel on which it was originally released, and how soon the hooking action begins to occur as the ball is rolling down a lane. A highly reactive ball will hook more than a less reactive ball, all other things being equal. A cover heavy ball will begin to hook further down the lane and/or change direction more slowly than a center heavy ball. That is to say, center heavy balls are said to react earlier in their path of travel whereas cover heavy balls are said to react later in their path of travel.

A variety of factors influence the selection of a ball by a bowler. A bowler who releases the ball with a relatively low velocity frequently will prefer a cover heavy ball so that the reaction does not occur to soon such that the ball hits too high in the pocket or even misses it entirely. Conversely a bowler who rolls a relatively high velocity ball will prefer a center heavy so as to assure that the desired reaction will occur sufficiently early that the ball will not slide by the pocket.

Of course, a large variety of factors other than core weight and geometry have a considerable affect on the reactivity of a ball. The material of which the cover is made quite obviously has an effect because of differing effect on the frictional characteristics of the surface of the ball. This invention, however, is not concerned with the effects of such variables. Rather, it is concerned with providing a core of novel geometry and with providing a family of bowling balls, at least some of which are of significantly varying weight, that have substantially identical reaction characteristics.

Typically, when a new ball having some sort of desired reactive characteristics is developed, great effort is applied to the details of coverstock formulation and the shape of the weight block of the sixteen pound prototype ball. Sixteen pound balls are chosen for the prototypes because they facilitate testing by professional and other high quality bowlers who almost exclusively use a sixteen pound ball.

Once the sixteen pound design is finalized as a result of such development and testing, lighter weight balls are produced by removing weight from the core of the sixteen pound design. Some manufacturers even change the core shape that was developed for the sixteen pound ball when making lighter weight balls in favor of any convenient shape with no regard for rotational dynamics. Weight is removed from the core as opposed to the cover stock because the resin and filler systems customarily employed to make cores can produce a much wider range of densities than the resin systems used to produce cover stock. However, removing weight from a core even while maintaining the same core shape produces bowling balls with different rotational dynamics and differing reaction characteristics.

Still another technique used to make lighter weight balls involves the use of a compound core design. Typically, this involves the use of a high density inner core and a low density outer core. With this technique, the ratio of cover density to core density that exists in a sixteen pound ball can be maintained in the ratio of the outer core density to the inner core density in the lightweight balls. Stated another way, the lightweight ball made according to this technique employs lower densities in the core to lower the weight of the ball but the cover to core density ratio is maintained. This represents a significant improvement over the method of simply removing weight from the core but even so, it fails to preserve the same rotational dynamics at ail weights. This is due to the fact that the cover stock remains of the same density for ail ball weights which in turn causes the reaction characteristics of the lighter weight balls to differ from those of the sixteen pound version.

According to the invention, the aforementioned problems with lightweight ball designs are avoided by designing lightweight balls so that they have proportionally the same relationship between their moment of inertia and the ball/lane frictional forces as a sixteen pound ball of the same family.

As is well known, the moment of inertia, which is the resistance to a change in the rotational state of an object, plays an important part in bowling ball reaction as explained more fully in U.S. Pat. No. 5,074,553. Further, dynamic or sliding fiction between the bowling ball and the surface of the bowling lane is substantially responsible for the forces which cause a ball to hook or curve as it travels down the lane. Dynamic fiction is, of course, directly proportional to the weight of the ball in the case of a bowling ball rolling on a bowling lane so that as the weight of the ball is decreased, the resulting frictional force is also decreased proportional to the decrease in weight.

By way of example, consider a twelve pound ball. The same is twenty-five percent lighter than a sixteen pound ball. To achieve substantially identical reaction characteristics (assuming identical cover stock, identical surface finish, identical position of grip holes relative to the core of the ball, the maximum, minimum and differential moments of inertia of the twelve pound ball would have to be approximately twenty-five percent lower than those of the sixteen pound ball.

Typically, lightweight balls have a lower maximum moment of inertia than does a heavier ball. However, the decrease is usually not proportional to the decrease in weight and the result is that lightweight balls have different rotational dynamics than heavier balls and as a consequence, differing reaction characteristics.

The practice of removing weight from the core while maintaining the same core shape is to be particularly avoided. A fifteen pound ball cast with the same internal core shape typically will lose more than twenty-five percent of the differential moment of inertia of the sixteen pound version. For a 14 pound ball, the loss will be sixty-six percent. This decrease of differential moment of inertia results in the lighter balls having different rotational dynamics than heaver weight balls and therefore, different reaction characteristics.

According to the present invention, proportional lowering of the moments of inertia and differential moments of inertia can be accomplished by maintaining the same radii of gyration and differential radius of gyration for all the balls in a family of balls of greatly varying weight.

SUMMARY OF THE INVENTION

It is the principal object of the invention to provide a bowling ball with a new and improved core geometry. It is also an object of the invention to provide a family of bowling balls having nearly identical reaction characteristics notwithstanding substantial weight differences between members of the family.

According to the invention in one aspect thereof, there is provided a bowling ball that includes a cover having a spherical outer surface and an internal core component within the cover. The core component is of a specific gravity different from that of the cover and is generally mushroom-shaped to have a flared cap and an elongated stem extending therefrom. The core further is generally symmetrical about the longitudinal axis of the stem.

In one embodiment, the cap is convex oppositely of the stem and concave adjacent the stem.

The invention contemplates the stem be frusto-conical, becoming progressively wider as the cap is approached.

In a preferred embodiment, the cap has a convex curved surface on its side remote from the stem and the curved surface extends past both sides of a diametral plane transverse to the longitudinal axis of the stem.

In one embodiment, the cap has a concave frusto-conical surface on its side adjacent the stem and the frusto-conical surface surrounds the stem.

In a highly preferred embodiment of the invention, there is provided a bowling ball which includes a cover of relatively low density material and having a spherical surface. A core is encapsulated by the cover and is made of a relatively higher density material. The core has a generally mushroom-shaped component provided with a stem and a cap on one end of the stem. The core component is shaped as a surface of revolution about a longitudinal axis extending through the stem and the cap has a convex, curved surface remote from the stem together with a concave surface merging with an edge of the convex surface and adjacent to and surrounding the stem. The cap further has an apex region adjacent the spherical surface. The edge of the convex surface to which the concave surface merges is on a side of a diametral plane extending through the ball and opposite of the apex region. The stem is tapered along its length and narrows in the direction away from the apex.

In one embodiment of the invention, the concave surface extends across the diametral plane. In another embodiment of the invention, the concave surface is entirely to one side of the diametral plane.

Preferably, the concave surface is frusto-conical.

In one embodiment of the invention, the core consists essentially of the core component. In another embodiment, the core component is encapsulated in an outer core which in turn is encapsulated within the cover.

According to another facet of the invention, a family of bowling balls having nearly identical reaction characteristics is provided. The family is made up of a plurality of bowling balls, each of the same nominal diameter, and each differing in weight from the others nominally by about one pound or more. Each ball includes a cover and a core of a material different from the cover. The covers on all balls are made of the same material. Each core is constructed and arranged within its cover to produce a first radius of gyration about a first axis and a second, different radius of gyration about a second axis generally transverse to the first axis. The first radius of gyration of all the balls are substantially identical and the second radius of gyrations of all the balls are also substantially identical.

In a preferred embodiment, the material of the cores has a different density from the material of the covers.

In one form of the invention, each of the cores has a component of a shape different from the shape of the component of the others of the balls.

In a highly preferred embodiment, each of the cores is of a different mass.

In one of the embodiments of the invention, each of the cores is of a different shape and a different mass.

According to this embodiment of the invention, however, the cores all have related shapes.

In the preferred embodiment invention, all of the cores have the related shape in the form of the shape of a mushroom.

Preferably, at least one of the balls has an inner and an outer core within its cover.

In a preferred embodiment of the invention, the first radius of gyration is the maximum radius of gyration for each ball and the second radius of gyration is the minimum radius of gyration for each ball.

According to one embodiment of the invention, the family of bowling balls is made up of a plurality of bowling balls each of the same nominal diameter and each differing in weight from the others by about one pound. Each ball includes a cover and a core of a material different from the cover with the covers on all the balls being made of the same material. Each core is constructed and arranged within its cover to produce a maximum radius of gyration about one axis and a minimum radius of gyration about a different axis. The maximum radius of gyration of all the balls are substantially identical and the minimum radii of gyration of all the balls are substantially identical.

According to the invention, there is provided a family of bowling balls generally as before. In this embodiment, the maximum radii of gyration of all the balls need not be substantially identical nor the minimum radii of gyration of all the balls need not be substantially identical, while the difference between the maximum and minimum radii of gyration is a differential radius of gyration and the differential radii of gyration of all the balls are substantially identical.

Other objects and advantages will become apparent from the following specification taken in connection with the following drawings.

Figure 1:
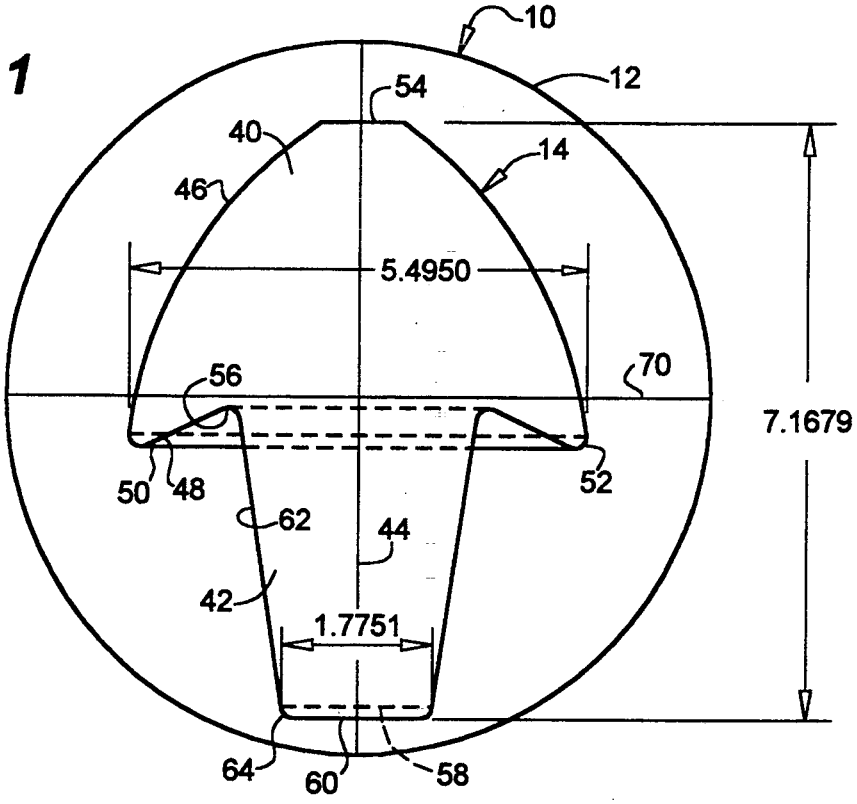
FIG. 1 is a sectional view of one bowling ball that is a member of a family of bowling balls having nearly identical reaction characteristics and made according to the invention to have a nominal weight of 16 lbs.

The drawings, FIGS. 1–4 inclusive, are to scale and the dimensions therein given are in inches.

DESCRIPTION OF THE PREFERRED EMBODIMENT

An exemplary embodiment of a family of bowling balls having substantially identical reaction characteristics and made up of four bowling balls, each of differing weight, is illustrated in FIGS. 1–4, with each such figure illustrating a different member of the family of balls. At the same time, it will also be appreciated from the description that follows that FIGS. 1–4 each illustrate a different embodiment of a core for a bowling ball made according to the invention. The different cores are related in shape as will be seen.

At the outset it should be recognized that finger holes (not shown) are intended to be drilled at the tops of the balls as shown in the various figures of drawing, on or about the Y-axis thereof.

Referring to the drawings, each ball is seen to be made of a first, outer component or cover, generally designated 10, having a spherical surface 12 which typically, according to the rules of the American Bowling Congress, will have a nominal diameter of 8.500 to 8.595 inches.

The cover may be made up of any of a variety of materials which form no part of the present invention. Typically, polyurethanes will be used. In one embodiment of the invention, the cover 10 may be formed of a polyurethane providing highly reactive characteristics and having a specific gravity of 1.11 while according to another embodiment of the invention, conventional polyurethane compounds may be used which have a specific gravity of 1.16.

The cover encapsulates a core having certain specified characteristics as will be seen. In FIG. 1, the core is generally designated 14 while in FIG. 2, a different core is generally designated 16. In FIG. 3, the core is generally designated 18 while in FIG. 4, the core is generally designated 20.

As is well known, bowling balls come in a variety of weights with a nominal one pound weight differential between balls of different weights. Given that all the balls have the same nominal diameter, the difference in weight is achieved by varying the ratio of the mass of the cover 10 to the mass of the core 14, 16, 18 or 20. This is achieved both by increasing or decreasing the ratio of the quantity of cover stock to core stock as well as by significantly altering the destiny of the core stock and, in many instances, by making the core of two or more materials, each having a different density. This latter approach is reflected in the balls illustrated in FIGS. 3 and 4 wherein the cores 18 and 20 respectively include an outer core, generally designated 22 and 24, respectively which is encapsulated by the cover 10 and which in turn encapsulates an inner, mushroom-shaped core component, generally designated 26 and 28 respectively. Typically, the outer core 22 or 24 has an outer spherical surface 30 which is concentric with the spherical surface 12 of the cover 10.

Figure 2:
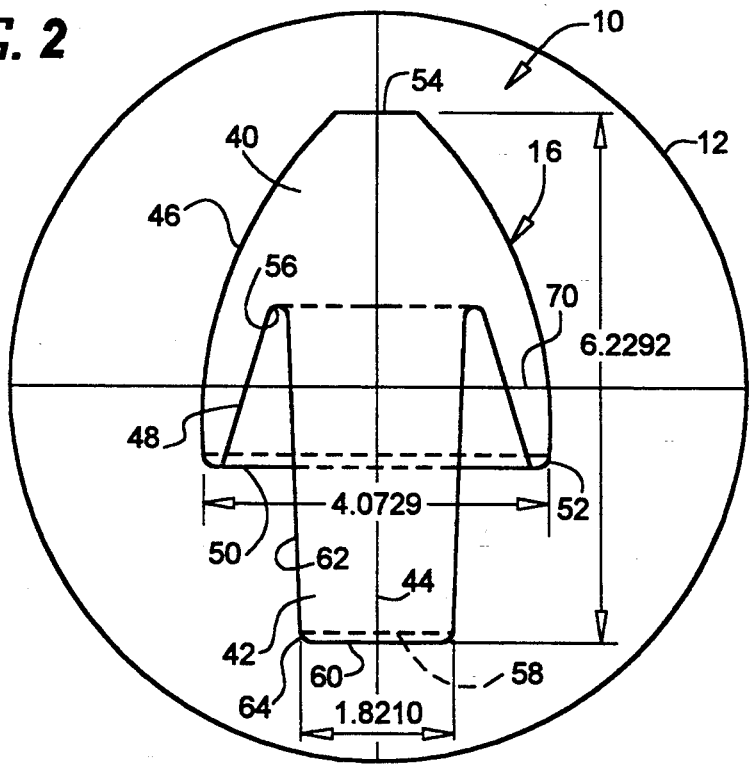
FIG. 2 is a sectional view of another member of the family of bowling balls, having a nominal weight of about 15 lbs.
Figure 3:
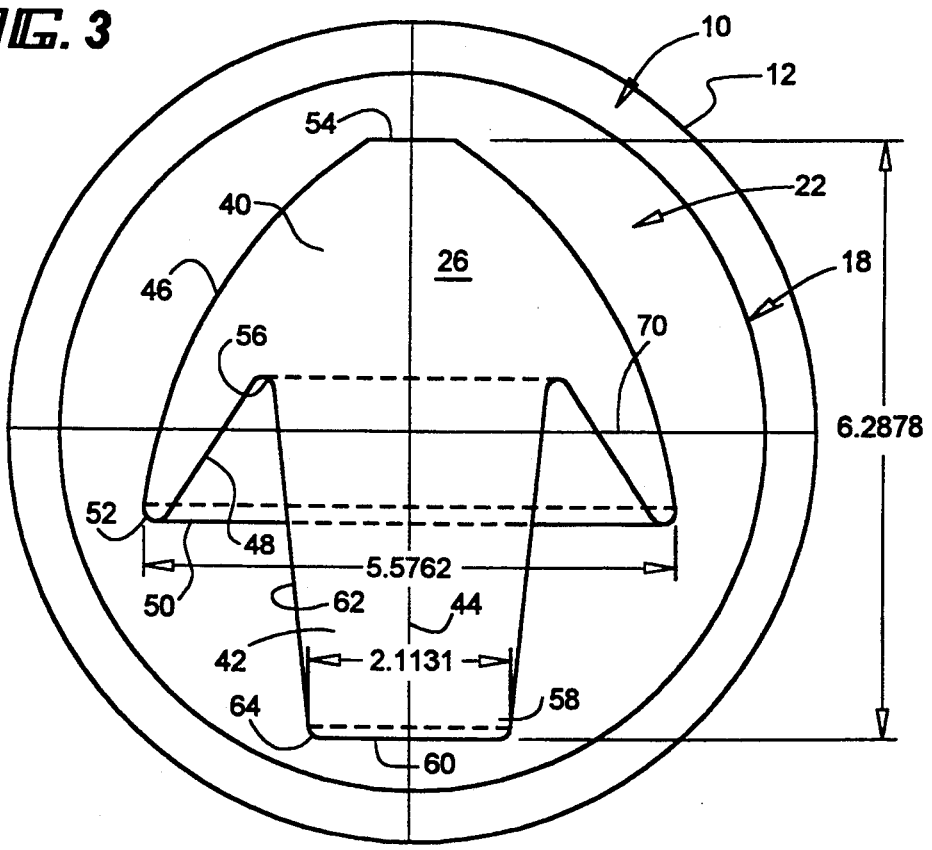
FIG. 3 is a sectional view of still another member of the family of balls, having a nominal weight of 14 lbs.
Figure 4:
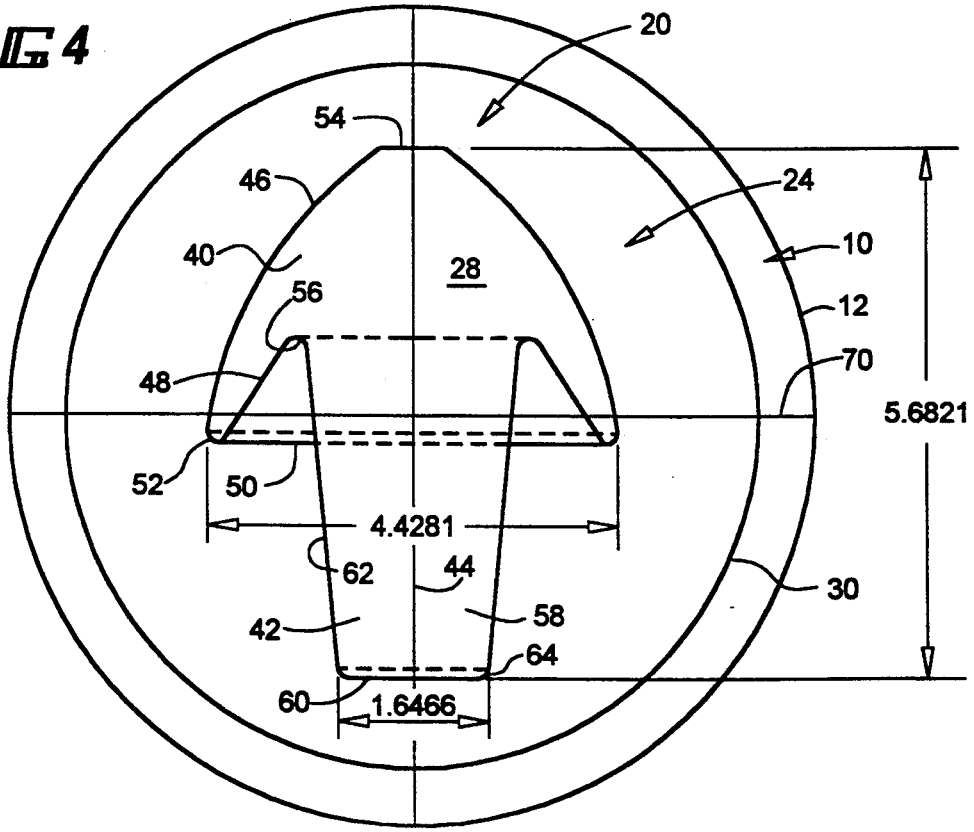
FIG. 4 is a sectional view of still another member of the family, having a nominal weight of 12 lbs.

The cores 14 and 16 of the balls illustrated in FIGS. 1 and 2 consist essentially of a mushroom-shaped core component that has a shape related to the shapes of the inner core components 26 and 28 of the balls illustrated in FIGS. 3 and 4. In each case, the core component 14, 16, 26 and 28 includes a flared cap 40 from which a stem 42 projects. Each core component 14, 16, 26 and 28 is defined by a surface of revolution centered upon an axis 44 which is the longitudinal center line of the stem 42.

As can be appreciated from the drawings, each flared cap 40 has a convex surface 46 on its side opposite the stem and a recessed or concave surface 48 on its side adjacent the stem 42. The surface 48 surrounds the stem 42 and merges with the convex surface 46 at an edge 50.

In fact, a small round 52 extends between the edge 50 and the convex surface 46. As is well known, the core components 14, 16, 26 and 28 will typically be formed by molding and the use of the round 52 avoids the presence of a relatively sharp edge that could chip or crack and affect the symmetry of the core component about the longitudinal axis 44.

Where the convex surface 46 approaches the longitudinal axis 44 remote from stem 42, each of the core components 14, 16, 26 and 28 is provided with a flat or planar surface 54 which is circular and centered on axis 44. As is well known, spacers are frequently used in the manufacture of bowling balls to precisely locate one surface of a core a predetermined distance from the spherical surface 22 of the cover 10. The spacers typically are in the form of small rings placed upon a mandrel and when abutted against the surface 54, provide the requisite precise positioning with respect to the spherical surface 12 in the vicinity of the longitudinal axis 44. The proper location of the remainder of each core component 14, 16, 26, 28 with respect to the surface 12 as well as with respect to the outer core 22, 24 in the case of the balls illustrated in FIGS. 3 and 4 is maintained by the mandrel as is well known.

The recessed or concave surfaces 48 preferably are all frusto-conical and merge at a round 56 with the corresponding stem 44. The round 56 is employed to achieve ease of release of the core component 14, 16, 26, 28 from the mold in which it is formed.

In fact, the narrow diameter of the frusto-conical, concave surface 48 merges with the largest diameter of the stem 42 which in turn is frusto-conical as is plainly illustrated in FIGS. 1, 2, 3 and 4. Again, the frusto-conical configuration of the stem 44 promotes ease of release of the core component 14, 16, 26, 28 from the mold in which it is formed.

The end 58 of the stem 42 remote from the cap 40 includes a flat area 60 which is generally parallel to the flat 54 and which is joined to the frusto-conical surface 62 of the stem by a round 64. The round 64 is employed at this location to avoid a sharp edge that might chip or crack, thus destroying the symmetry of the core component 14, 16, 26, 28 about the axis 44.

It will be observed that in all embodiments, the concave surface 46 extends to both sides of a diametral plane through the ball and represented by a line 70 which is transverse to the axis 44. The same is true of the surface 48 in all embodiments except the ball illustrated in FIG. 1. In this case, the surface 48 is entirely to one side of the plane 70.

The cores are formed of conventional materials, namely, polyester resin systems. As is well known, various fillers may be employed in the cores to achieve a desired density, and thus, a desired weight for a given core shape. Typically, glass microballoons are utilized as fillers when the core is to have a relatively low density while calcium carbonate is used as a filler where the core is to have a relatively high density.

As noted previously, FIGS. 1–4 are all scale drawings and the dimensions given therein stated in inches. The core shapes illustrated and described have a number of advantages over those heretofore used. For one, because of their unique shape, they are easily removed from the mold in which they are typically formed.

For another, the basic mushroom-shape enables one to make a family of balls having substantially identical reaction characteristics even though there may be substantial weight differences from one ball to the next in the family.

The use of the convex surface 46 on the cap 40 results in a ball that, after being drilled for a bowler's finger holes, has more core component 14, 16, 26, 28 intact, i.e. remaining, and this is believed to have a lesser effect on changing the basic dynamics of the ball than would be the case if more of the core component were removed in the drilling operation.

In addition, the shape is such that it may be readily modified for design purposes to achieve desired changes in reactivity.

In making balls as illustrated in FIGS. 1—4, it has been found that the X-axis radius of gyration and the Z-axis radius of gyration are invariably almost the same and both will be greater than the Y-axis radius of gyration. Hence, in the following description, it should be understood that references to the maximum radius of gyration, are references to the X-axis radius of gyration, while references to the minimum radius of gyration, are references to the radius of gyration about the Y-axis.

In making the ball of FIG. 1, which is intended to be a nominally 16 lb. ball, a polyester resin system having a specific gravity of 2.3 is employed to result in the core 14 having a weight of 5.36 lbs. The ball itself will actually weigh 16.00 pounds. A spacer of 0.625 inches is utilized in abutment with the surface 54 during the ball molding process and a polyurethane cover having a specific gravity of 1.11 is utilized.

The resulting ball was found to have a maximum radius of gyration of 2.5837 inches, a minimum radius of gyration of 2.5525 inches, and a differential radius of gyration, that is, a difference between the maximum and minimum radius of gyration of 0.0312 inches.

FIG. 2 is illustrative of a ball constructed to have a nominal weight of 15 lbs. In practice, the weight will be about 15.22 lbs. Again, a cover stock of polyurethane having a specific gravity of 1.11 is used to form the cover. The core component 16 is made up of a polyester resin system whose specific gravity is adjusted through the use of fillers to 2.66. For the dimension and shape illustrated, this results in a core weight of 3.32 lbs. A 0.64 inch spacer was employed in the molding process.

The resulting ball had a maximum radius of gyration of 2.6061 inches, a minimum radius of gyration of 2.5745 inches and a differential radius of gyration of 0.0316 inches.

The ball illustrated in FIG. 3 is nominally a 14 lb. ball with an actual weight of about 14.25 lbs. In one embodiment, a polyurethane cover stock with a specific gravity of 1.11 was used while the core component 26 was fabricated to have a weight of 5.03 lbs. using a polyester resin system adjusted with fillers to a specific gravity of 2.55. The outer core 22 was formed with any material typically used in forming the outer part of a two-part core and had its specific gravity adjusted to 0.78. The total core weight was 9.47 lbs. and a 0.228 inch spacer was used.

In this case, the ball shown in FIG. 3 had a maximum radius of gyration of 2.5790 inches, a minimum radius of gyration of 2.5483 inches and a differential radius of gyration of 0.0307 inches.

In FIG. 4, a nominal 12 lb. ball is illustrated. In practice, the weight will be about 12.23 lbs. Again, a polyurethane cover system having a specific gravity of 1.11 is employed. The core component 28 is formed of a polyester resin system modified through the use of fillers to have a specific gravity of 2.65 which in turn will result in the core component 28 having a weight of 2.84 lbs. The specific gravity of the outer core material 24 and which is otherwise conventional is 0.7. The total core weight is 7.45 lbs. When molded with the use of a 0.96 inch spacer, the resulting ball will have a maximum radius of gyration of 2.6485 inches, a minimum radius of gyration of 2.6173 inches and a differential radius of gyration of 0.0312 inches.

From the foregoing, it will be seen that the differential radius of gyration for each of the four balls illustrated and described is about 0.0312 inches$\pm$0.0005. It will also be appreciated that there is substantial identity between the maximum radius of gyration of each of the balls as well as between the minimum radius of gyration of each of the balls. The radius of gyration is as conventionally defined, namely, is equal to the square root of the moment of inertia divided by the mass.

It has been determined that by making the differential radius of gyration of each of the balls substantially identical one to the other, virtually identical reaction characteristics are achieved. This may be most conveniently done to produce a minimum variation in results by making the maximum radius of gyration of each ball substantially identical one to the other and the minimum radius of gyration of each ball substantially equal one to the other as the foregoing demonstrates.

Using the mushroom-shaped core of the invention simplifies the attainment of these desirable features to allow the construction of a family of balls having the same reaction characteristics irrespective of the weight of the various members of the family. This, in turn is an advantage to outfitting a bowler with proper equipment. For example, Bowler A may witness Bowler B rolling the 16 lb. ball shown in FIG. 1 in a bowling game. Bowler A observes the reaction characteristics of the ball and believes they would suit his game perfectly. However, Bowler A is not accustomed to throwing a 16 lb. ball. Rather, Bowler A is accustomed to throwing a 14 lb. ball.

Heretofore, only by pure happenstance, at best, and perhaps never at worst, could Bowler A find a 14 lb. ball having the same reaction characteristics as the 16 lb. ball being used by Bowler B. Now however, with the invention, it is a simple matter to obtain the same reaction characteristics simply by obtaining a 14 lb. ball from the same family of balls, namely, the ball illustrated in FIG. 3.

Thus, the mushroom-shaped cores of the present invention provide an excellent building block whereby an entire family of bowling balls having virtually identical reaction characteristics may be fabricated to provide a ball in every one of several categories of desirable weights. And the provision of such a family makes it possible for bowlers to select balls based on reaction characteristics without regard to weight considerations.

It is to be particularly noted that while the fifteen and sixteen pound balls illustrated in FIGS. 1 and 2 are shown as having only a single piece core, the invention contemplates that a three piece core may be utilized in balls of these weights. Similarly, while the various balls of the family shown in FIGS. 1–4 all illustrate a mushroom-shaped core component that has a greater dimension along its longitudinal axis than across the cap at its wider part, that relations:hip may be reversed, depending upon the reaction characteristics desired.

Finally, while the balls illustrated in FIGS. 3 and 4 herein have two piece cores wherein the outer core component is of a lesser density than the mushroom-shaped core component, the opposite may be true, particularly where one is interested in making a relatively heavy ball, i.e., a fifteen or sixteen pound ball, with a two piece core.

Thus, it will be understood that the invention is susceptible to a number of variations as will occur to those skilled in the art and should not be measured by the preferred embodiments disclosed herein, but rather, solely by the scope of the appended claims.

We claim:

1. A family of bowling balls having nearly identical reaction characteristics comprising:

a plurality of bowling balls, each of the same nominal diameter and each nominally differing in weight from the others by about one pound or more;

each ball including a cover and a core of a material different from the cover with the covers on all balls being made of the same material;

each core being constructed and arranged within its cover to produce a first radius of gyration about a first axis and a second, different radius of gyration about a second axis generally transverse to said first axis;

the first radius of gyration of all said balls being substantially identical;

the second radius of gyration of all said balls being substantially identical.

2. The family of bowling balls of claim 1 wherein the material of the cores has a density different from the material of the covers.

3. The family of bowling balls of claim 1 wherein each of said cores has a component of dimension different from the dimension of the components of the other of said balls.

4. The family of bowling balls of claim 1 wherein each of said cores is of a different mass.

5. The family of bowling balls of claim 1 wherein each of said cores is of a different shape and of a different mass.

6. The family of bowling balls of claim 5 wherein all said cores have similar shapes.

7. The family of bowling balls of claim 6 wherein all said cores are generally mushroom shaped.

8. The family of bowling balls of claim 1 wherein at least one of said balls have an inner and an outer core within its cover.

9. The family of bowling balls of claim 1 wherein said first radius of gyration is the maximum radius of gyration for each ball and wherein said second radius of gyration is the minimum radius of gyration for each ball.

10. A family of bowling balls having nearly identical reaction characteristics comprising:

a plurality of bowling balls, each of the same nominal diameter and each nominally differing in weight from the others by about one pound or more;

each ball including a cover and a core of a material different from the cover with the covers on all balls being made of the same material;

each core having means to produce a maximum radius of gyration about one axis and a minimum radius of gyration about a different axis;

the maximum radius of gyration of all said balls being substantially identical;

the minimum radius of gyration of all said balls being substantially identical.

11. A family of bowling balls having nearly identical reaction characteristics comprising:

a plurality of bowling balls, each of the same nominal diameter and each nominally differing in weight from the others by about one pound or more;

each ball including a cover and a core of a material different from the cover with the covers on all balls being made of the same material;

each core having means to produce a maximum radius of gyration about one axis and a minimum radius of gyration about a different axis;

the difference between said maximum and minimum radii of gyration being a differential radius of gyration;

the differential radii of gyration of all said balls being substantially identical.

* * * * *